US006354265B1

(12) United States Patent
Hampton et al.

(10) Patent No.: US 6,354,265 B1
(45) Date of Patent: Mar. 12, 2002

(54) ELECTRO-MECHANICAL LATCHING ROCKER ARM ENGINE BRAKE

(75) Inventors: Keith Hampton, Ann Arbor; Kynan L. Church, Ceresco, both of MI (US); William C. Dumphy, Williamsburg, VA (US); Richard L. Madden, Marshall; David M. Preston, Clarkston, both of MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/693,666

(22) Filed: Oct. 20, 2000

(51) Int. Cl.[7] ..... F02D 13/04
(52) U.S. Cl. ..... 123/321; 123/322
(58) Field of Search ..... 123/320, 321, 123/90.15, 90.16, 322, 90.11

(56) References Cited

U.S. PATENT DOCUMENTS 5,195,489 A 3/1993 Reich ..... 123/321
5,365,916 A 11/1994 Freiburg et al. ..... 123/320
5,730,102 A * 3/1998 Arnold et al. ..... 123/322
5,829,397 A * 11/1998 Vorih et al. ..... 123/321
5,957,101 A * 9/1999 Schmitz et al. ..... 123/321
6,152,104 A * 11/2000 Vorih et al. ..... 123/321
6,253,730 B1 * 7/2001 Gustafson ..... 123/321

* cited by examiner

*Primary Examiner*—Erick Solis
(74) *Attorney, Agent, or Firm*—L. J. Kasper

(57) ABSTRACT

A compression release engine brake assembly adapted for use with an internal combustion engine, and an exhaust valve (29) operable to open in a normal exhaust lift event (FIG. 9) and in a brake lift event (FIG. 15). The engine includes an exhaust valve actuating mechanism (23,31,37) for imparting reciprocal movement to said exhaust valve (29) in response to rotation of a cam shaft (11) including a cam profile (13), a normal lift portion (17) and a brake lift portion (19). The assembly includes a lost motion device (75) moveable between a normal lost motion condition (FIG. 4) and an actuated condition (FIG. 14) in response to movement of an input member (91). An energy storage spring (117) is operable, after being compressed to an energy storage condition (FIG. 12) to be able to bias the input member (91) toward a second position, effecting the actuated condition of the lost motion device (75). A latching mechanism (99,103–113,129,131) is operable to first displace the energy storage spring (117) to a compressed condition, and then release it just before the cam follower (21) traverses the brake lift portion (19), in response to the pivotal movement of the rocker arm assembly (23) which comprises part of the exhaust valve actuating mechanism.

12 Claims, 17 Drawing Sheets

FIG. 2

ELECTRO-MECHANICAL LATCHING ROCKER ARM ENGINE BRAKE

CROSS-REFERENCE TO RELATED APPLICATIONS

Not Applicable.

STATEMENT REGARDING FEDERALLY SPONSORED RESEARCH OR DEVELOPMENT

Not Applicable.

MICROFICHE APPENDIX

Not Applicable.

BACKGROUND OF THE DISCLOSURE

The present invention relates to compression release engine brakes, and more particularly, to an electromechanical latching rocker arm type of engine brake mechanism.

A compression release engine brake is a device for use with an internal combustion engine which operates by allowing compressed gas (typically, air) to be released by the exhaust valve during the compression stroke, near the top dead center position of the piston within the cylinder. As a result, energy is expended by the engine to compress the gas, but no useful work is returned to the piston, and the net result, with an engine brake device functioning on one or more cylinders, is an effective braking of the engine. Typically, the fuel supply to the engine (e.g., fuel injectors) is turned off during operation of the engine brake.

By braking or "retarding" the operation of the engine, the speed of the vehicle being propelled by the engine may be substantially reduced, thereby reducing the need to use the conventional wheel brakes of the vehicle. Thus, the use of an engine brake will substantially increase the life of the conventional wheel brakes, and will also provide for safer operation of the vehicle, especially when operating in hilly terrain. In other words, even if there is a problem with the conventional wheel brakes, when actuated by the vehicle operator, the engine braking system will still provide enough braking capacity to bring the vehicle safely under control.

Although engine brakes are used primarily on larger vehicles such as trucks (and typically, on engines having a displacement of about 10 liters or more) and most trucks are equipped with diesel engines, it should be understood that the engine brake of the present invention could be applied to either a diesel or Otto cycle type of engine. Furthermore, although the present invention will be described in connection with a center-pivot rocker arm type of valve gear train, those skilled in the art will understand that the invention may be used advantageously with any pivoting rocker arm type of valve gear train, for reasons which will become apparent subsequently.

Conventional compression release engine brakes typically include hydraulic circuits for transmitting a mechanical input to the exhaust valves to be opened, as part of the braking event. Such hydraulic circuits typically include a master piston which is reciprocated in a master piston bore by a mechanical input from the engine, such as the pivoting movement of the fuel injector rocker arm. Hydraulic fluid in the circuit transmits the motion of the master piston to a slave piston in the circuit which, in turn, reciprocates in a slave piston bore in response to the flow of hydraulic fluid in the circuit. The slave piston acts either directly or indirectly on the exhaust valve to be opened to achieve the engine braking.

One of the problems associated with the conventional prior art compression release engine brake system of the hydraulic type is that the source of hydraulic pressure (such as the master piston described above) would typically operate continuously, thus wasting engine horsepower when the vehicle is operating in an environment in which the engine brake is seldom used, for example, when travelling over relatively flat roads. Also, in looking toward the future, it is anticipated that most fuel injection systems for truck diesel engines will be of the "common rail" type, in which fuel is communicated through a common passage, rather than having individual fuel injectors. Elimination of the fuel injectors, and the associated injector rocker arms, would eliminate what is effectively a "free" mechanical input to the hydraulic pump.

The typical compression release engine brake sold commercially by Jacobs Vehicle Systems is one which uses the pivoting motion of the fuel injector rocker arm as the mechanical input to the pump to supply hydraulic pressure to an engine braking mechanism. In the systems currently supplied by Jacobs (under the trademark "Jake brake"), the exhaust valve is subjected to undesirable valve motion, in both the opening and closing directions of movement. The result is that the engine braking system "distresses" the exhaust valve, thus decreasing the effective life of those exhaust valves which are part of the engine braking system, and increasing the maintenance costs for the engine. In addition, in many vehicle engine applications, the size and weight of the conventional Jake brake is such that other parts of the engine, such as the rocker cover, must be modified to accommodate the engine braking system. Thus, the overall cost of using the prior art system is likely to be excessive, and may limit the commercial application of the prior art engine brakes.

It would be desirable to have an engine braking system which does not require a source of hydraulic pressure, for the reasons mentioned above. However, it would also be important, if the system were mechanical, and especially if the system involved some sort of "lost motion" device, for the transition between the unactuated and actuated conditions to occur in less time than it takes for the cam shaft to make one complete revolution. In fact, it would be quite desirable for the system to be able to make the required transition in less than half of the cycle of the cam shaft, i.e., between the normal exhaust valve event and the time of the braking event, which occurs at "Top Dead Center" of the compression stroke.

BRIEF SUMMARY OF THE INVENTION

Accordingly, it is an object of the present invention to provide an improved compression release engine brake mechanism which does not require hydraulic actuation, and therefore, avoids the complexity and expense associated with fluid pressure operated devices, as well as the sealing problems associated therewith, and the wasted engine horsepower to maintain such a system pressurized.

It is another object of the present invention to provide an improved engine braking mechanism which accomplishes the above-stated object without adversely affecting the exhaust valve in terms of additional loading on the valve and the resulting reduction in the useful life of the valve.

It is a more specific object of the present invention to provide an improved engine braking mechanism which does not involve any modification of the normal exhaust event for the exhaust valve, but instead, merely adds the braking event to the cam profile.

It is a still further object of the present invention to provide an improved engine braking mechanism in which movement of the mechanism into the "braking" mode is triggered by the release of a stored energy spring for fast actuation.

The above and other objects are accomplished by the provision of an improved compression release engine brake assembly adapted for use with an internal combustion engine of the type including an engine piston reciprocally mounted within a cylinder for cyclical successive compression and expansion strokes. An exhaust valve is operable to open in a normal exhaust lift event and in a brake lift event. The engine includes an exhaust valve actuating mechanism for imparting reciprocable movement to the exhaust valve in response to rotation of a cam shaft including a cam profile defining a base circle portion, a normal lift portion and a brake lift portion rotationally displaced from each other on the cam profile. The exhaust valve actuating mechanism includes a cam follower adapted for operative engagement with the cam profile and a valve engagement portion adapted for engagement with the exhaust valve.

The improved engine braking assembly is characterized by the exhaust valve actuating mechanism including a lost motion device disposed in series relationship with the exhaust valve and being moveable between a normal, lost motion condition and an actuated condition not providing lost motion, in response to movement of an input member between first and second positions, respectively. A biasing spring normally biases the input member toward the first position. An energy storage spring is operable, after being compressed to an energy storage condition, to be able to bias the input member toward the second position in opposition to the force of the biasing spring. A latch mechanism is operable to displace the energy storage spring from a non-compressed condition to a compressed condition in response to the movement of the valve actuating mechanism as the cam follower traverses the normal lift portion of the cam profile. The latch mechanism is operable to release the energy storage spring just before the cam follower traverses the brake lift portion of the cam profile, thereby permitting the energy storage spring to displace from the compressed condition to a relatively non-compressed condition, and thus move the input member to the second position, moving said lost motion device to said actuated condition.

DETAILED DESCRIPTION OF THE PREFERRED EMBODIMENT

Figure 1:
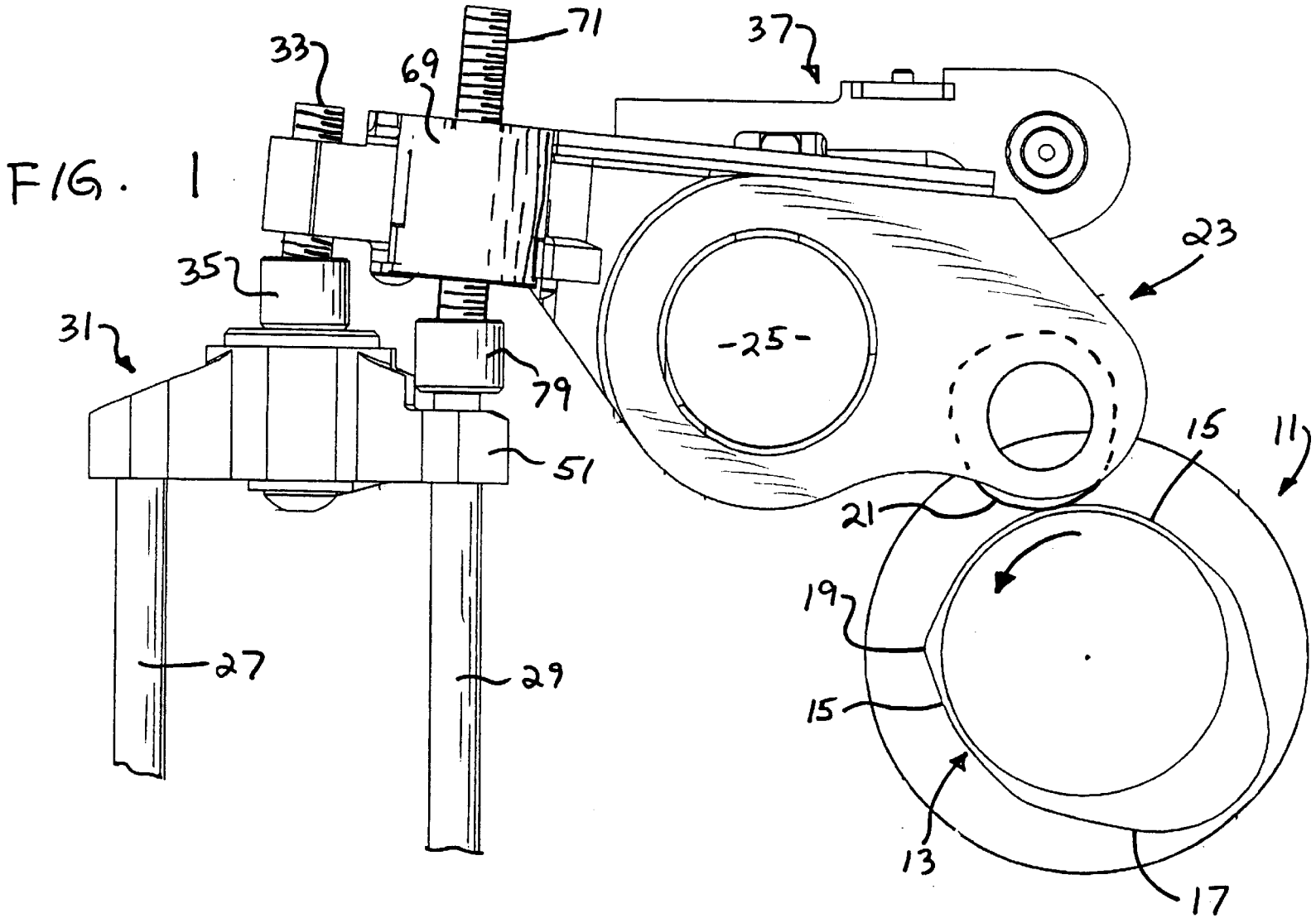
FIG. 1 is a somewhat schematic, fragmentary side plan view of a typical valve gear train of the type with which the present invention may be utilized.

Referring now to the drawings, which are not intended to limit the invention, FIG. 1 illustrates a valve gear train of the center-pivot rocker arm type, although it should be understood that the use of the present invention is not so limited. By way of example only, the present invention could also be used in connection with an end-pivot rocker arm type of valve gear train or with a pushrod type of valve gear train. All that is essential to the present invention is that the valve gear train include a rocker arm, or some functionally equivalent structure, which undergoes pivotal movement in response to rotation of the cam shaft, or of some functionally equivalent input to the valve gear train.

Referring still to FIG. 1, it will be understood that much of the associated structure, such as the cylinder head, has been omitted for ease of illustration. However, those portions of the engine structure which have been omitted are items which are well known to those skilled in the art, and the details of which are not essential to the present invention.

In FIG. 1, there is a cam shaft, generally designated 11 including a cam profile generally designated 13. The cam shaft 11 is shown, by way of example only, as rotating in a counter-clockwise direction, and such is shown also in corresponding FIGS. 7, 9, 11, 13 and 15. The cam profile 13 includes a base circle portion 15, and it should be noted that the cam profile 13 includes two separate sections of the base circle portion 15. The cam profile 13 also includes a normal lift portion 17 and a brake lift portion 19.

In engagement with the cam profile 13 is a cam follower, shown herein as a roller 21, which is supported to rotate relative to a rocker arm assembly, generally designated 23. In the subject embodiment, and by way of example only, the rocker arm assembly 23 is pivotable about a support member 25 (also referred to hereinafter as a "pivot location"), not shown in detail herein, but well known to those skilled in the art. Typically, the support member 25 would be supported by, or relative to, support portions cast integral with the cylinder head. Those skilled in the art will understand that if the present invention were applied to another type of valve gear train, such as a push rod type, for example, the term "cam follower" would mean and include both the actual cam follower and the push rod.

Figures 2, 3:
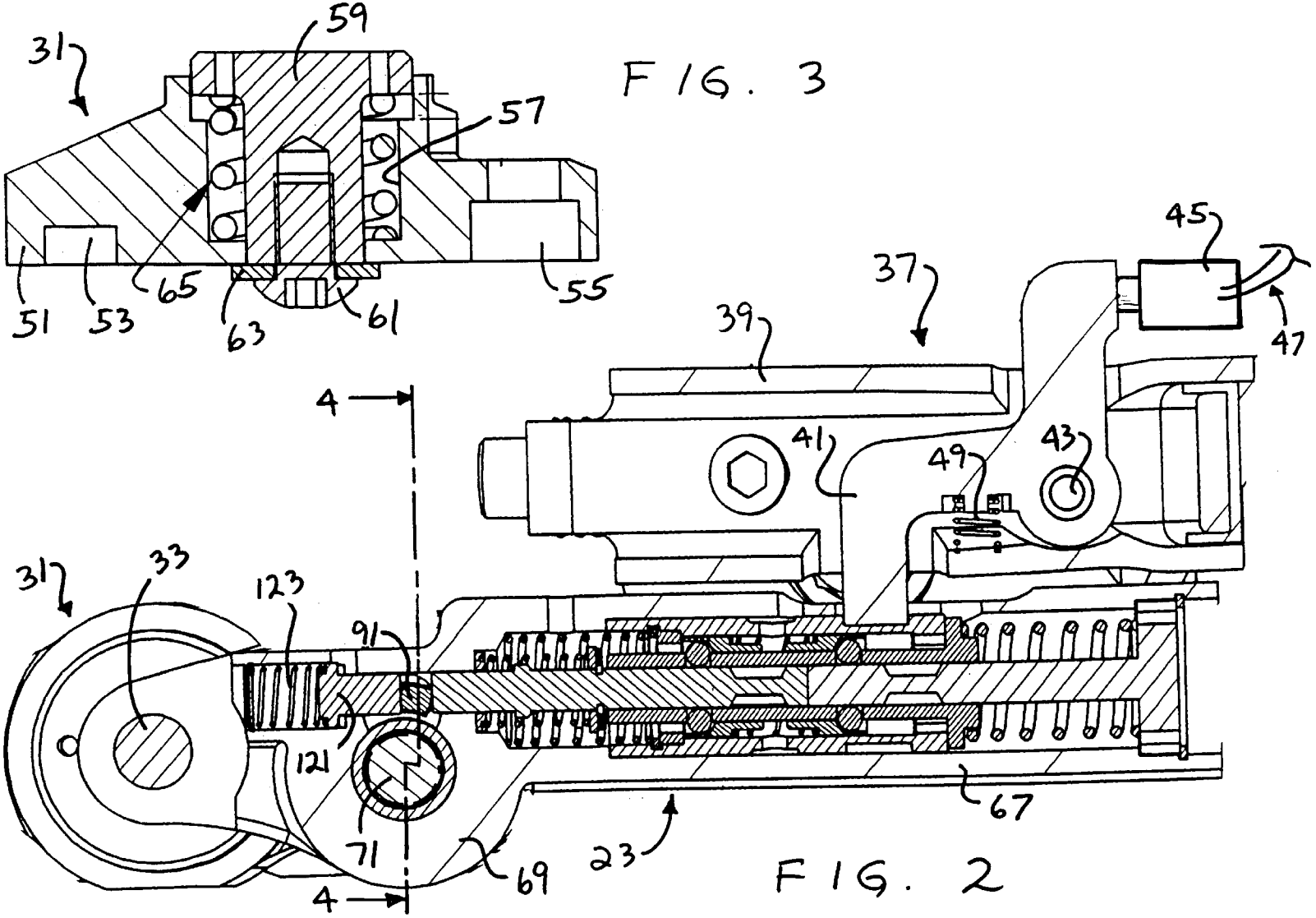
FIG. 2 is a generally horizontal view, partly in plan view and partly in axial cross-section, of one portion of the valve gear train shown in side plan view in FIG. 1.
FIG. 3 is an enlarged, vertical axial cross-section taken through the bridge assembly shown in side plan view in FIG. 1.

The valve gear train shown in FIG. 1 further includes a pair of exhaust valves 27 and 29, shown only fragmentarily herein, with the upper ends of the exhaust valves 27 and 29 being operatively associated with a bridge assembly, generally designated 31 (see also FIG. 3). It should be understood that the use of a bridge assembly is not an essential feature of the invention, but is included mainly because an engine brake system is more commonly utilized in engines having two exhaust valves per cylinder, and the use of a bridge assembly simplifies the normal actuation of the exhaust valves 27 and 29.

Referring now to FIG. 2 in conjunction with FIG. 3, the actuation end (left end) of the rocker arm assembly 23 includes a threaded member 33 which extends through the rocker arm and has its lower end in FIG. 1 in engagement with a swivel-type foot member 35 of a type which is well known to those skilled in the art. The underside of the foot member 35 engages an upper surface of the bridge assembly 31, such that movement in an up and down direction is transmitted by the threaded member 33 to the bridge assembly 31, and then to the exhaust valves 27 and 29.

Disposed behind the rocker arm assembly 23 in FIG. 1 (and "above" it in FIG. 2) is an actuator assembly, generally designated 37, which is visible in FIGS. 1, 7, 9, 11, 13, and 15 primarily because in each view, an upper portion of the rocker arm assembly 23 has been "removed". The actuator assembly 37 includes an actuator housing 39, and disposed therein is an actuator lever 41, one portion of which is fixed to the housing 39 by means of a pivot pin 43 (see FIG. 2), such that the actuator lever 41 is pivotable about the axis of the pivot pin 43. The actuator lever 41 is biased toward the position shown in FIG. 2 by an electromagnetic actuator, shown schematically at 45, which is energized by means of an electrical input signal, represented schematically in FIG. 2 by a pair of electrical leads 47. The actuator lever 41 is biased away from the actuated position shown in FIG. 2, toward an unactuated position (to be described in greater detail subsequently), by means of a biasing spring 49 (see also FIG. 4). Those skilled in the art will understand that the construction details of the actuator assembly 37 are not essential features of the present invention, and all that is essential is to have some sort of actuator assembly which is able to perform the intended function, to be described subsequently.

Referring now to FIG. 3 in conjunction with FIG. 1, the bridge assembly 31 will be described in further detail. The assembly 31 includes a bridge member 51 defining a short bore 53 which receives the upper end of the exhaust valve 27, and the bridge member 51 also defines a counter bore 55. As is shown only in FIG. 4, the upper end of the stem of the exhaust valve 29 is received within a bore defined by an actuator rod 56 which is seated in the counter bore 55, such that downward movement of the bridge assembly 31 causes downward movement of both of the exhaust valves 27 and 29. Thus, the rocker arm assembly 23, the bridge assembly 31, and the actuator assembly 37 together will also be referred to hereinafter as an "exhaust valve actuating mechanism". The bridge member 51 also defines a relatively larger stepped bore 57, and disposed therein is a striker 59, the upper surface of which is in engagement with the underside of the foot member 35. At the lower end of the striker 59 and in threaded engagement therewith, is a machine screw 61 and a retainer washer 63, which serves as a stop, limiting the upward movement of the striker 59, relative to the bridge member 51.

Figure 15:
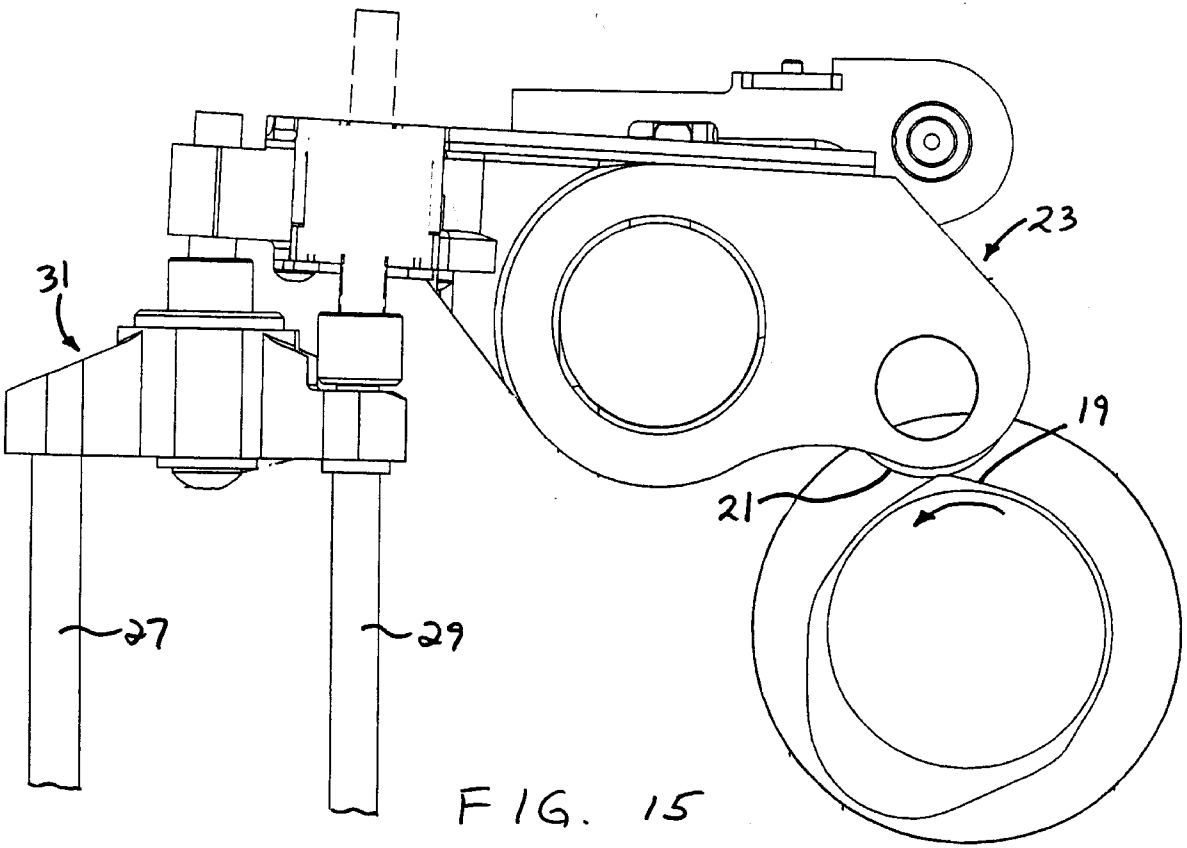
FIG. 15 is a plan view of the valve gear train with the cam follower on the peak of the brake lift portion of the cam profile.
Figure 16:
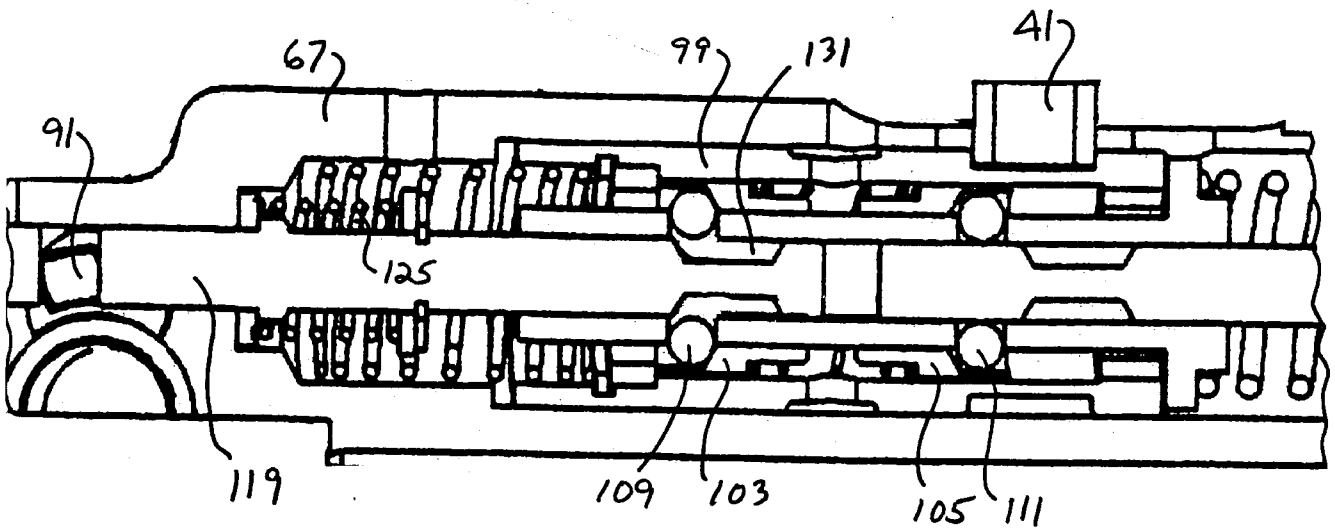
FIG. 16 is a further enlarged, fragmentary, horizontal cross-section of the present invention in a position corresponding to that of FIG. 15.
Figure 17:
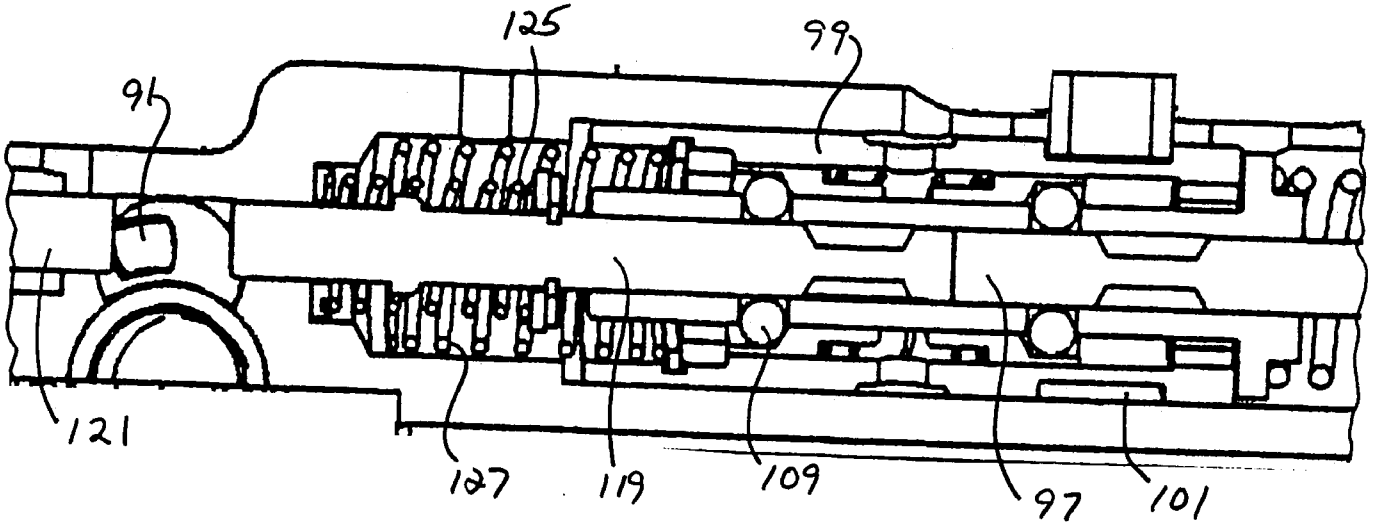
FIG. 17 is another horizontal cross-section of the present invention in the position corresponding to a slight rotation of the cam beyond the position shown in FIG. 15.

Disposed within the stepped bore 57, and surrounding the reduced diameter portion of the striker 59 is a lost motion compression spring 65. As is well known to those skilled in the art, each of the exhaust valves 27 and 29 is biased upwardly in FIG. 1 toward its closed position by means of a valve spring (not shown herein). When the cam follower 21 is on the normal lift portion 17 of the cam profile 13 (FIGS. 7 through 11), the pivotal movement of the rocker arm assembly 23 first compresses the spring 65 until the larger diameter portion of the striker 59 is seated at the upper end of the bore 57. Thereafter, further pivotal movement of the rocker arm assembly 23 will move the entire bridge assembly 31 downward, opening both exhaust valves 27 and 29. The purpose of the small amount of "lost motion" built into the bridge assembly 31 will be described subsequently in connection with the operation on the brake lift portion 19 of the cam profile 13 (FIGS. 15 through 17).

Figure 4:
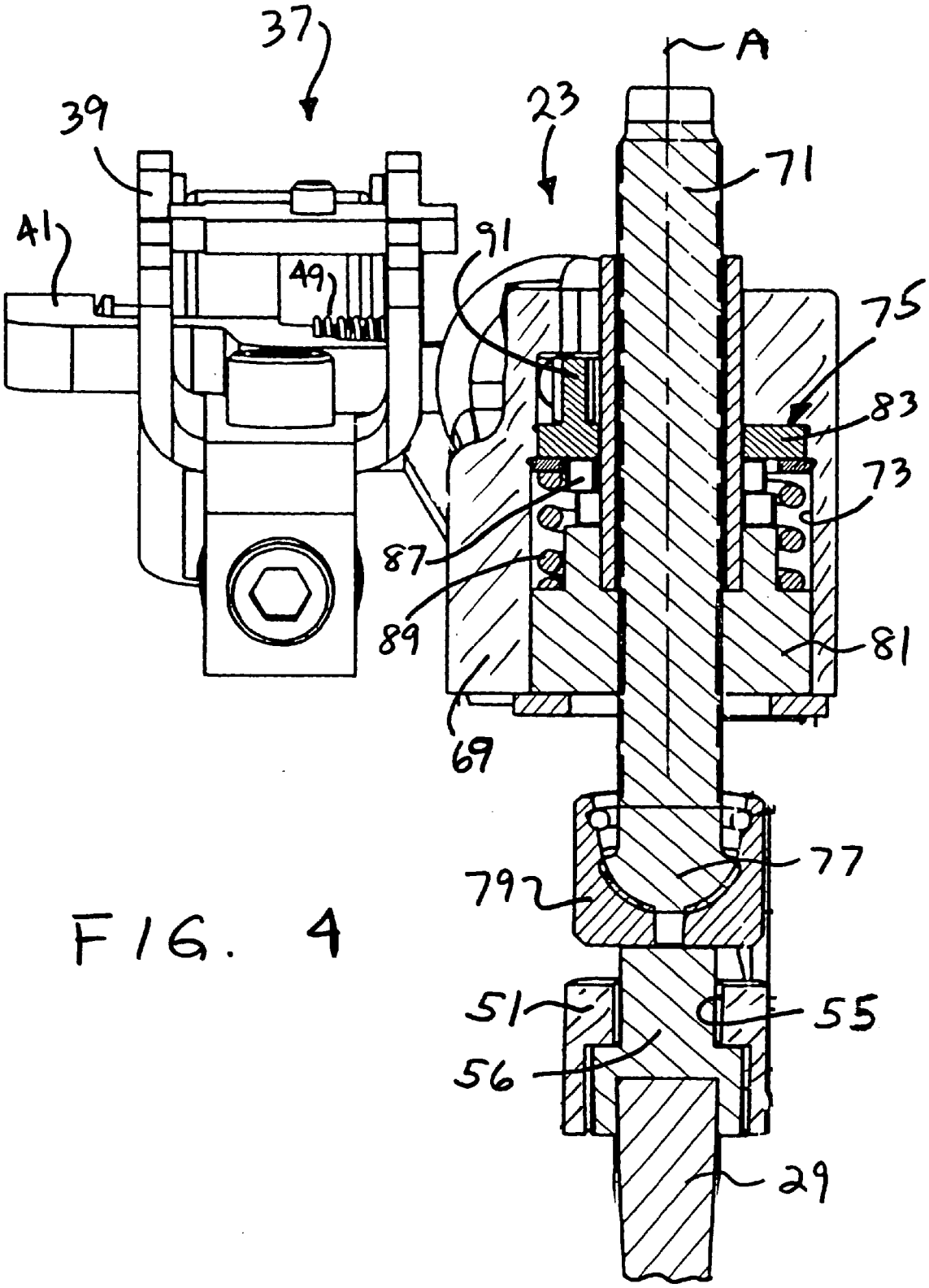
FIG. 4 is an enlarged, fragmentary, transverse cross-section taken on line 4—4 of FIG. 2, and illustrating the lost motion device of the present invention.
Figure 5:
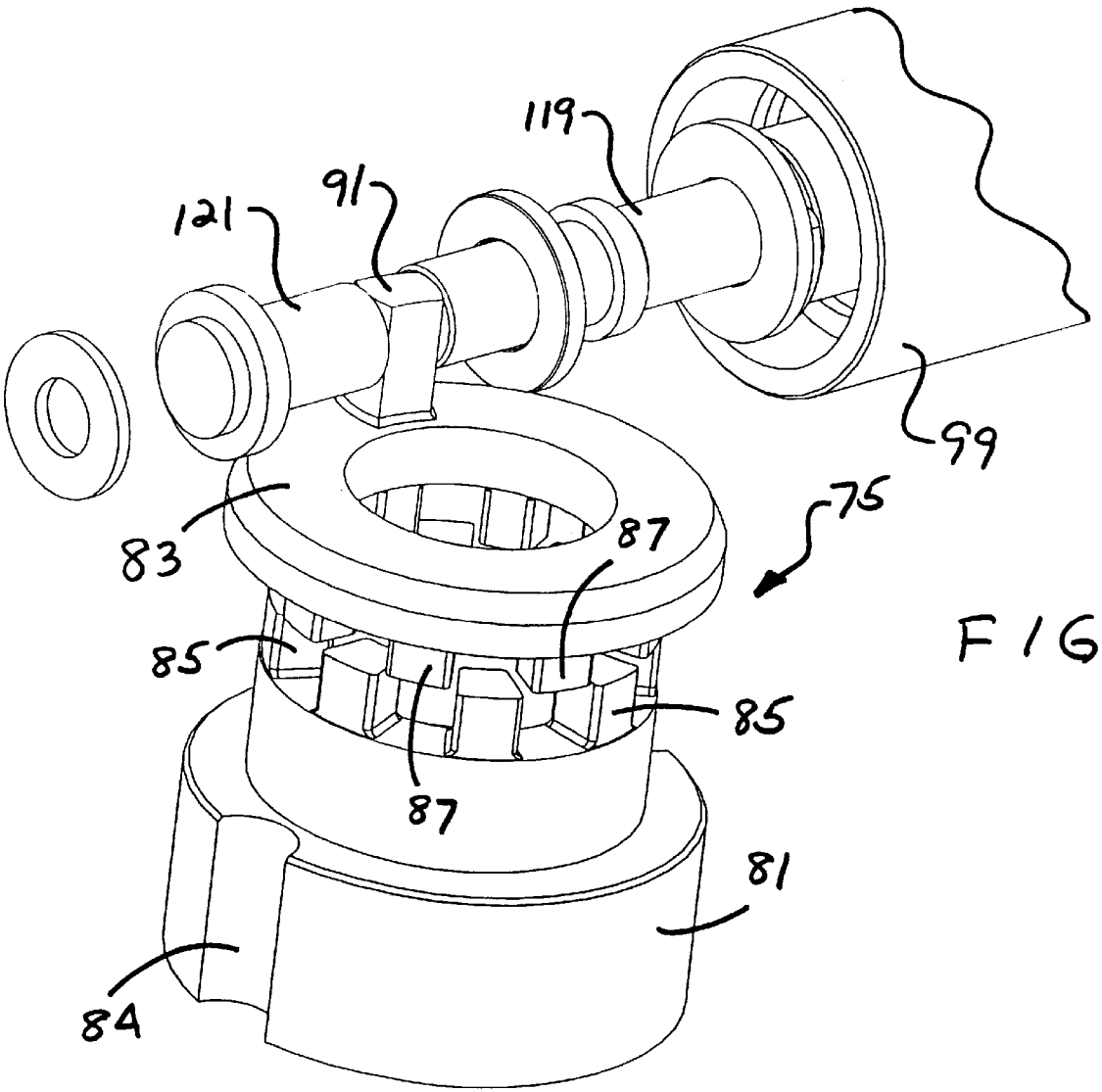
FIG. 5 is a fragmentary, perspective view showing the two castle members, with their teeth in a meshing position.

Referring now primarily to FIG. 4, in conjunction with FIGS. 1 and 2, it may be seen that the rocker arm assembly 23 comprises a rocker arm housing 67, including a somewhat cylindrical, integral housing portion 69, and extending vertically therethrough is a lash adjustment screw 71. The cylindrical housing portion 69 defines an internal chamber 73 (shown only if FIG. 4) and disposed therein is a lost motion device, generally designated 75 (see also FIG. 5), to be described in greater detail subsequently. The lower portion of the lash adjustment screw 71 defines a somewhat spherical head 77 which is disposed within a swivel-type foot member 79. The connection between the threaded member 33 and the foot member 35 may be substantially the same as is shown in FIG. 4 for the spherical head 77 and the foot member 79.

The lost motion device 75 includes a lower castle member 81 and an upper castle member 83. The lower castle member 81 is rotationally fixed within the chamber 73, by any suitable means, such as a key (not shown herein) being disposed within a keyway 84 (shown only in FIG. 5). The upper castle member 83 is both axially moveable, and rotatable within the chamber 73. The members 81 and 83 are referred to by the term "castle" because they are preferably annular, are concentric about an axis of rotation A, and include annular arrays of axially extending teeth, such as the array of teeth 85 on the lower castle member 81 and the similar, annular array of teeth 87 on the upper castle member 83. It should be noted that, in the position of the castle members shown in FIG. 5, the teeth 85 and 87 are said to be in a "meshed" condition, i.e., downward movement of the upper castle member 83 would result in the teeth 85 and 87 being interdigitated, such that no downward movement would thereby be transmitted to the lower castle member 81.

As is generally well known to those skilled in the art of lost motion devices, the members 81 and 83 can have either of two possible operating positions. In the position shown in FIG. 4, with the rocker arm assembly 23 operating on the base circle portion 15, the castle members 81 and 83 are biased apart, axially, by means of a compression spring 89. The upper castle member 83 includes an input member 91 (shown in FIGS. 2, 4 and 5) and with the input member 91 in the "normal" position shown in FIGS. 2 and 5, the upper castle member 83 is rotated to a position such that each of the teeth 87 is aligned with one of the openings between the teeth 85 (i.e., the meshed condition described previously). Thus, with the castle members 81 and 83 in the relative rotational position represented in FIGS. 2 and 5, pivotal movement of the rocker arm assembly 23 would merely cause the upper castle member 83 to move downward such that the teeth 85 and 87 would "mesh", but there would be no resulting downward movement of the lower castle member 81 or of the screw 71, or of the exhaust valve 29. In other words, "lost motion" would occur in the valve gear train for the exhaust valve 29, at least in terms of actuation thereof by means of the housing portion 69 and lash adjustment screw 71.

Figure 14:
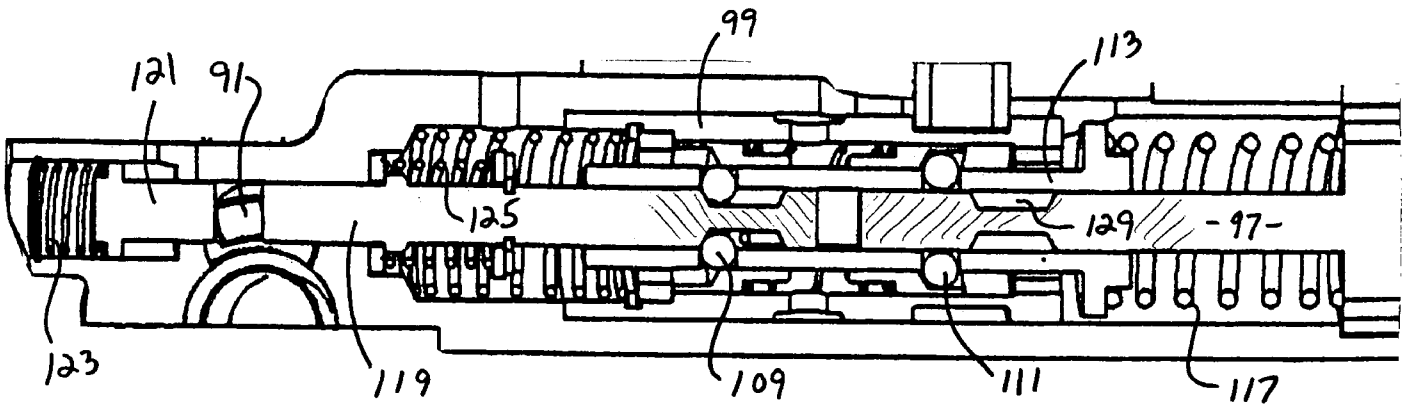
FIG. 14 is an enlarged, fragmentary, horizontal cross-section of the present invention in a position corresponding to that of FIG. 13, just after moving the lost motion device to its actuated condition.

If the input member 91 were moved from the normal position shown in FIG. 2 to that shown in FIG. 14, the result would be rotation of the upper castle member 83 to a position in which each of the teeth 87 would be aligned with (axially "abutting") one of the teeth 85. However, because of the spring 89, the teeth would still be out of engagement, thus permitting "no load" rotation of the upper castle member 83, relative to the lower castle member 81. In this unmeshed, tooth aligned (or tooth abutting) relationship described, pivotal movement of the rocker arm assembly 23 will now be transmitted from the housing portion 69 to the member 83, to the member 81, and then to the screw 71 and through the foot member 79 to the upper end of the exhaust valve 29 (without corresponding movement of the bridge member 51). In other words, in this "actuated" condition (not providing lost motion), a small amount of pivotal movement of the rocker arm assembly 23 will result in a small amount of opening movement, but of only the exhaust valve 29. It should be noted that in the condition just described, the amount of input movement to the bridge assembly 31 (as will be described in connection with FIGS. 15 and 16), is only enough to move the striker 59 and compress the lost motion spring 65, but is not enough to move the bridge member 51 downward. The valve spring for the exhaust valve 27 would have a higher spring rate that that of the compression spring 65.

Figures 6, 6A:
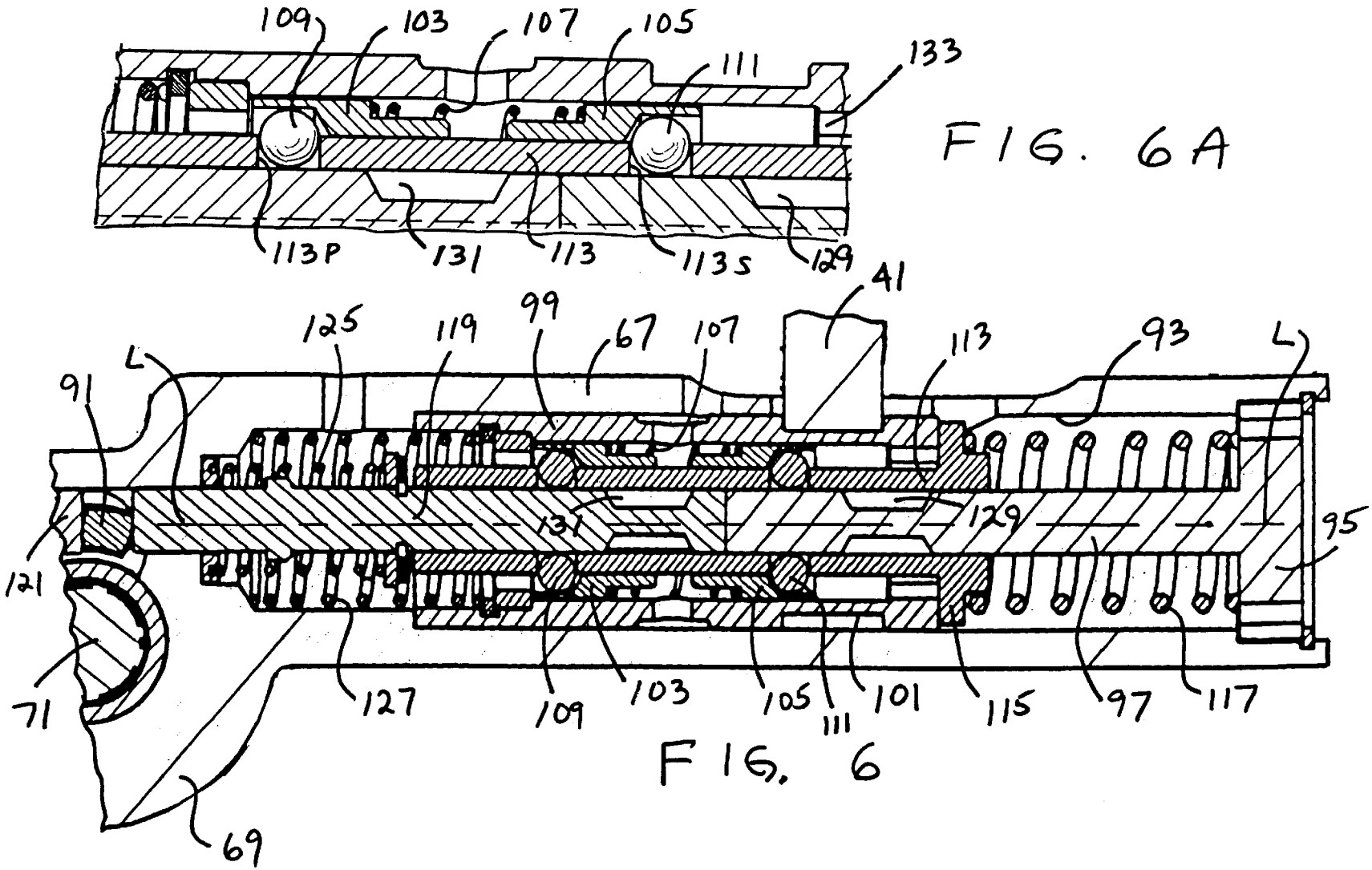
FIG. 6 is an enlarged, fragmentary, horizontal cross-section, similar to FIG. 2, illustrating the valve actuating mechanism of the present invention in a position corresponding to that of FIG. 1, on the base circle.
FIG. 6A is a further enlarged, fragmentary, horizontal cross-section, similar to FIG. 6, illustrating a portion of the valve actuating mechanism in greater detail.

Referring now primarily to FIG. 6, the portion of the present invention within the rocker arm housing 67 will be described. The rocker arm housing 67 defines an elongated, generally cylindrical, stepped bore 93 and trapped within the largest portion of the bore 93 (at the right end in FIG. 6) is a generally cylindrical head portion 95 of a reaction rod 97. Slidably disposed within the central portion of the bore 93 is an outer actuator sleeve 99 defining an annular groove 101. When the actuator assembly 37 is in its actuated condition (FIG. 2), the inner end of the actuator lever 41 is disposed within the annular groove 101. However, during most of the duty cycle of the engine, the lever 41 is biased by the spring 49 to an unactuated condition, in which the lever 41 is removed from the annular groove 101. In that unactuated condition, the input member 91 will stay in the normal, lost motion position shown in FIGS. 2, 4, and 6, and the exhaust valve 29 will not open as the cam follower 21 engages the brake lift portion 19 of the cam profile.

Referring now primarily to FIGS. 6 and 6A, disposed within the outer actuation sleeve 99 is a primary ball sleeve 103 and a secondary ball sleeve 105. The ball sleeves 103 and 105 are biased apart, axially, by a compression spring 107. Received within the primary ball sleeve 103 is a set of four primary latch balls 109, and received within the secondary ball sleeve 105 is a set of four secondary latch balls 111, although only two of the balls 109 are shown, and only two of the balls 111 are shown in FIG. 6. It should be understood by those skilled in the art that the particular number of latch balls 109 or 111 is not essential, and in fact, it is not essential that balls be used as the latch members, and various other latching arrangements could be used within the scope of the present invention.

Disposed within the sleeves 103 and 105 is an inner sleeve 113 including a spring seat portion 115 disposed toward its right end in FIG. 6. Seated between the head portion 95 and the spring seat portion 115 is an energy storage spring 117, the function of which will be described in greater detail subsequently. Although most springs are inherently energy storage devices, the term "energy storage" is used herein only in regard to the spring 117 because of its unique function in actuating the lost motion device 75, as will be described in greater detail subsequently. The inner sleeve 113 defines a set of four openings (radial holes) 113P, each of which receives one of the primary latch balls 109, and similarly, the sleeve 113 defines another set of four openings (radial holes) 113S, each of which receives one of the secondary latch balls 111. Preferably, the openings 113P and 113S defined by the inner sleeve 113 are sized to permit relatively free radial movement of the balls 109 and 111, relative to the inner sleeve 113, but yet, the balls are fitted close enough within the openings 113P and 113S such that axial movement of the inner sleeve 113 will result in corresponding axial movement of the latch balls 109 and 111.

Disposed within the inner sleeve 113, and aligned axially with the reaction rod 97 is an actuator rod 119. As may best be seen in FIG. 6, the reaction rod 97 and the actuator rod 119 cooperate to define a linear axis L, and the sleeves 99, 103, 105 and 113 are all concentric about the linear axis L, as is the bore 93. Thus, the various parts of the mechanism of the present invention (except for the balls 109 and 111) move along the linear axis L, and the axis L pivots about the pivot location (i.e., the support member 25) as the rocker arm assembly 23 pivots. With the actuator rod 119 in the position shown in FIG. 6, abutting the reaction rod 97, the input member 91 is biased to its normal, lost motion condition by means of a return member 121 and a return spring 123 (see FIG. 2). Surrounding the actuator rod 119 is a compression spring 125, biasing the actuator rod 119 to the right in FIG. 6. Surrounding the spring 125 is a compression spring 127, which is seated so as to bias the outer actuator sleeve 99 toward the right in FIG. 6.

The reaction rod 97 defines an annular groove 129, and similarly, the actuator rod 119 defines an annular groove 131, the function of the grooves 129 and 131 to become apparent subsequently.

Operation

Figure 18:
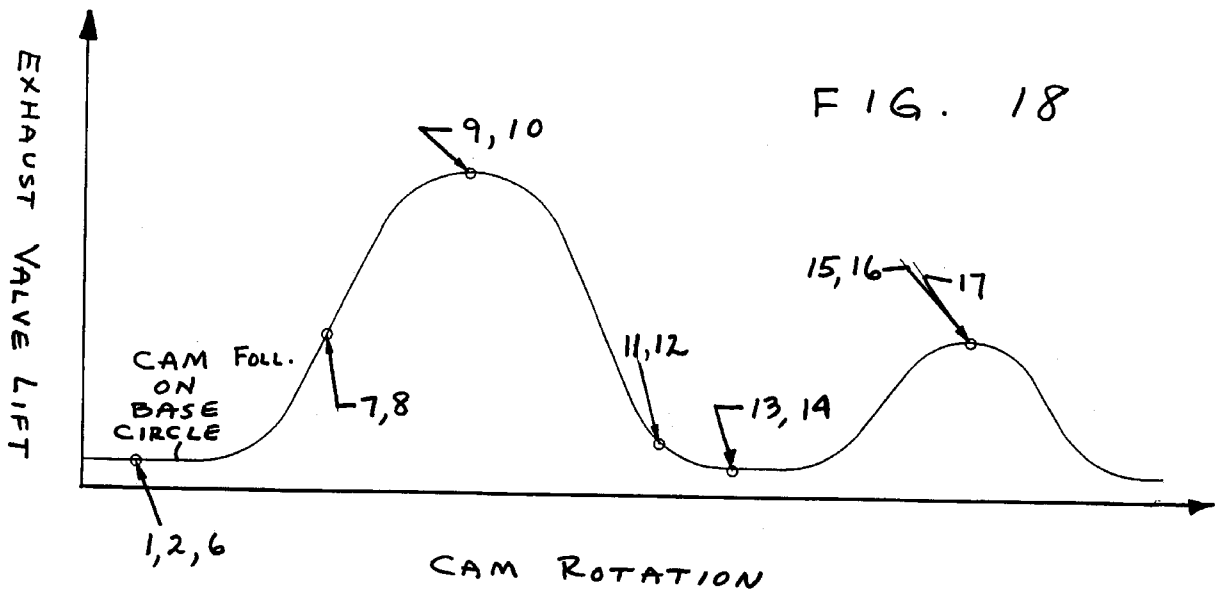
FIG. 18 is a graph of exhaust valve lift versus cam rotation, with the curve bearing a label identifying the position of each of the various drawing figures corresponding to that particular position on the graph.

Referring now primarily to FIGS. 6 through 18, the operation of the compression release engine brake assembly of the invention will be described. Throughout the description of the operation of the invention, reference should be made to FIG. 18 which is a graph of Exhaust Valve Lift as a function of Cam Rotation. On the graph of FIG. 18, there are six different points identified, with each point on the graph being accompanied by one or more numerals which are the particular drawing figures corresponding to that particular location on the graph. Referring first to FIGS. 1 and 6, when the cam follower 21 is on the base circle portion 15 of the cam, the rocker arm assembly 23 is in the orientation shown in FIG. 1. With the rocker arm assembly 23 in the position shown in FIG. 1, the outer actuator sleeve 99 is biased all the way to the left in FIG. 6, engaging a step defined by the rocker arm housing 67. During operation on the base circle, the energy storage spring 117 is in a nearly fully-extended (relatively non-compressed) condition as shown in FIG. 6, and all of the latch balls 109 and 111 are in contact with the outer cylindrical surfaces of the actuator rod 119 and the reaction rod 97, respectively.

Figure 7:
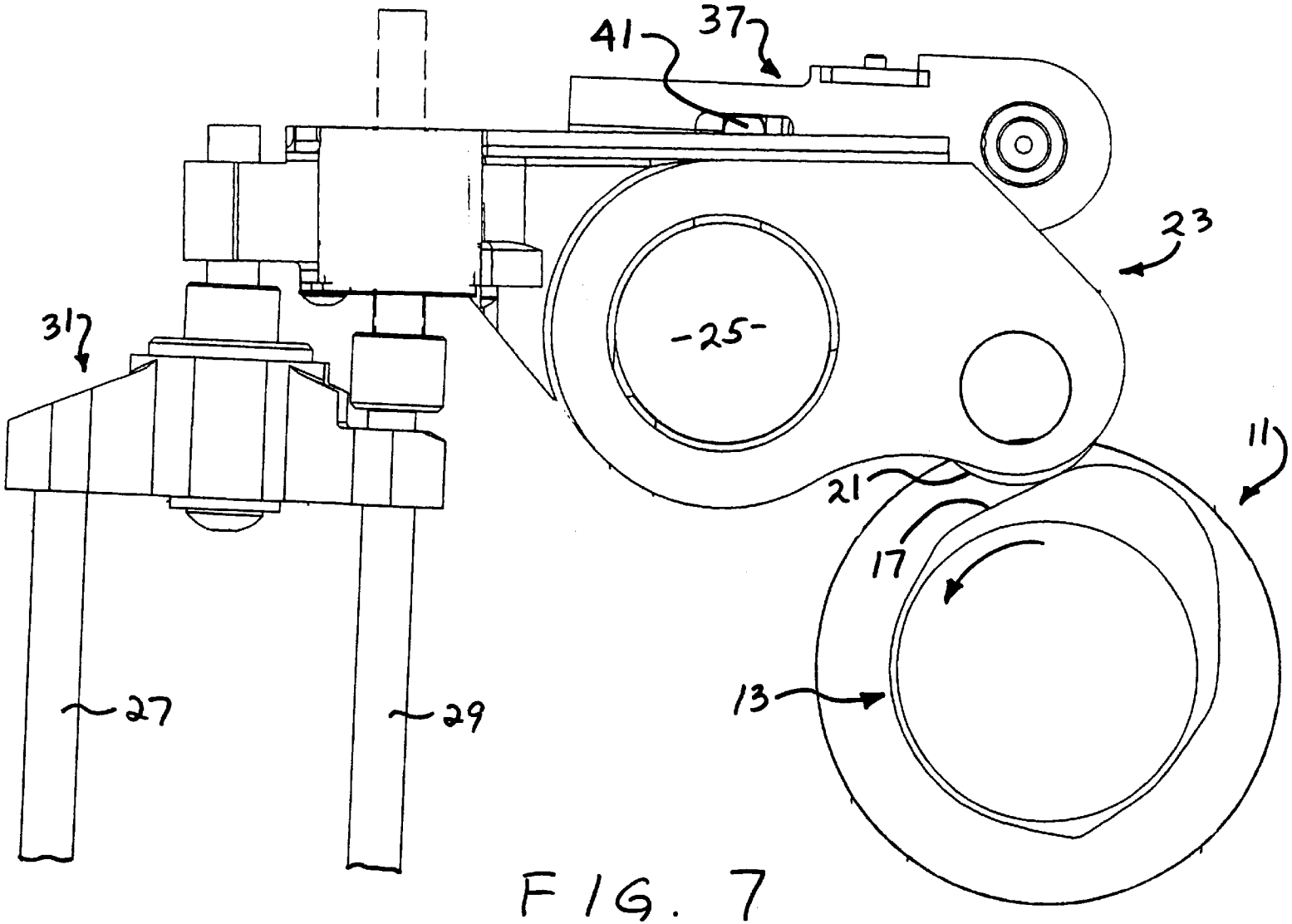
FIG. 7 is a plan view of the valve gear train, similar to FIG. 1, but with the cam shaft rotated such that the cam follower is on the normal exhaust lift portion of the cam profile.
Figure 8:
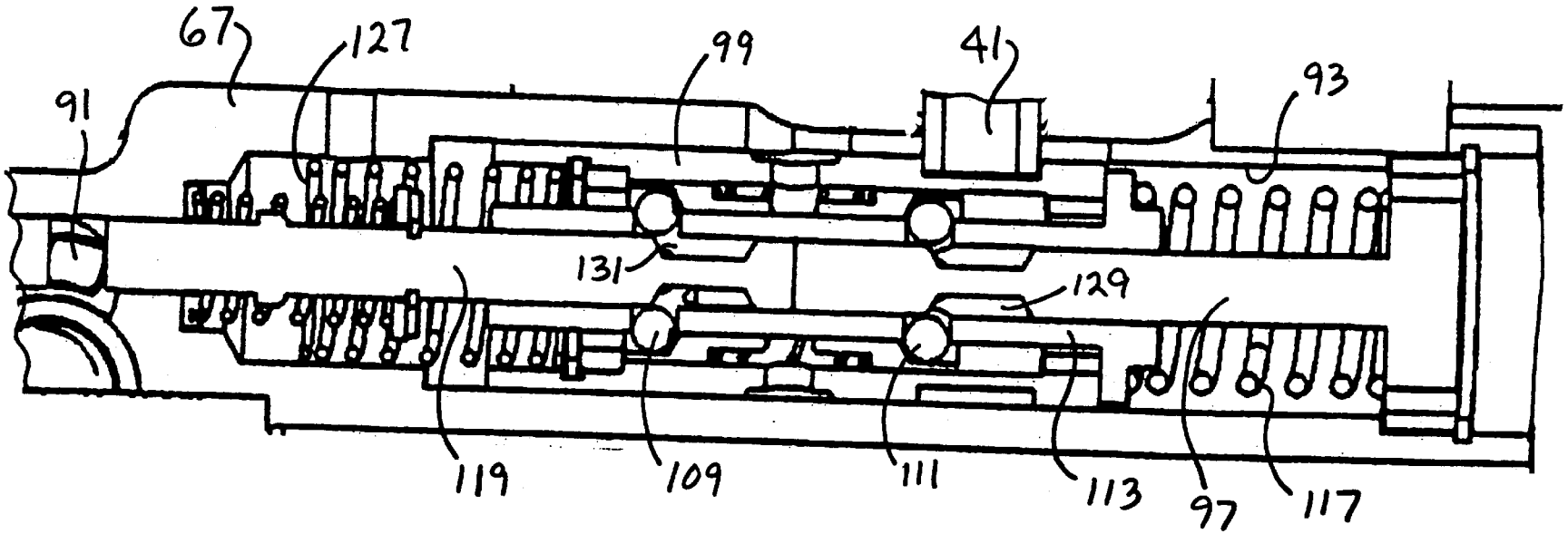
FIG. 8 is an enlarged, fragmentary, horizontal cross-section of the present invention in a position corresponding to that of FIG. 7.

Referring next primarily to FIGS. 7 and 8, as the cam shaft 11 rotates counterclockwise, the cam follower 21 traverses the normal lift portion 17 of the cam profile 13, thus causing the rocker arm assembly 23 to rotate somewhat about the support member 25, in a counterclockwise direction from the position shown in FIG. 1. In accordance with an important aspect of the invention, the pivotal movement of the rocker arm assembly 23, relative to the stationary actuator lever 41, results in the outer actuator sleeve 99 being moved to the right in FIG. 8 relative to the rocker arm housing 67. Such rightward movement of the sleeve 99 also moves to the right in FIG. 8 the inner sleeve 113, thus beginning to compress the energy storage spring 117. At the same time, the rightward movement of the inner sleeve 113 moves the set of primary latch balls 109 just to the edge of the annular groove 131, and moves the set of secondary latch balls 111 just to the edge of the annular groove 129. At the point in the operation cycle, represented by FIGS. 7 and 8, the actuator rod 119 is still in abutting relationship to the reaction rod 97 (which never moves relative to the housing 67), and therefore, the input member 91 is still in its normal, lost-motion condition, under the biasing force of the return spring 123. With the rocker arm assembly 23 pivoted to the position shown in FIG. 7, the bridge assembly 31 is moved downward enough to overcome the lost motion within the bridge assembly 31 (i.e., the compression of the lost motion compression spring 65), and begins to move the exhaust valves 27 and 29 downward, such that the exhaust valves begin to open.

Figure 9:
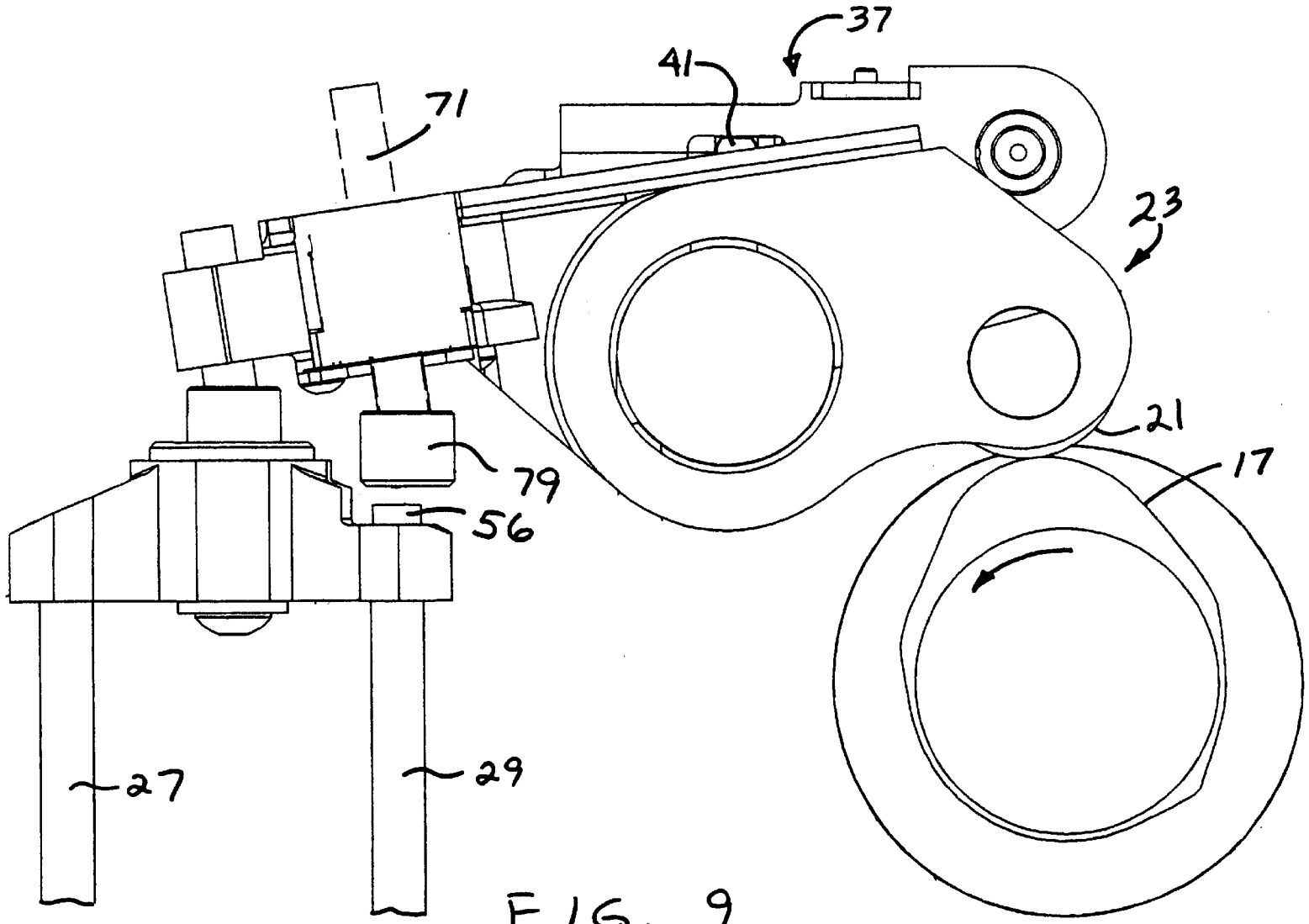
FIG. 9 is a plan view of the valve gear train with the cam follower engaging the maximum lift portion of the cam profile.
Figure 10:
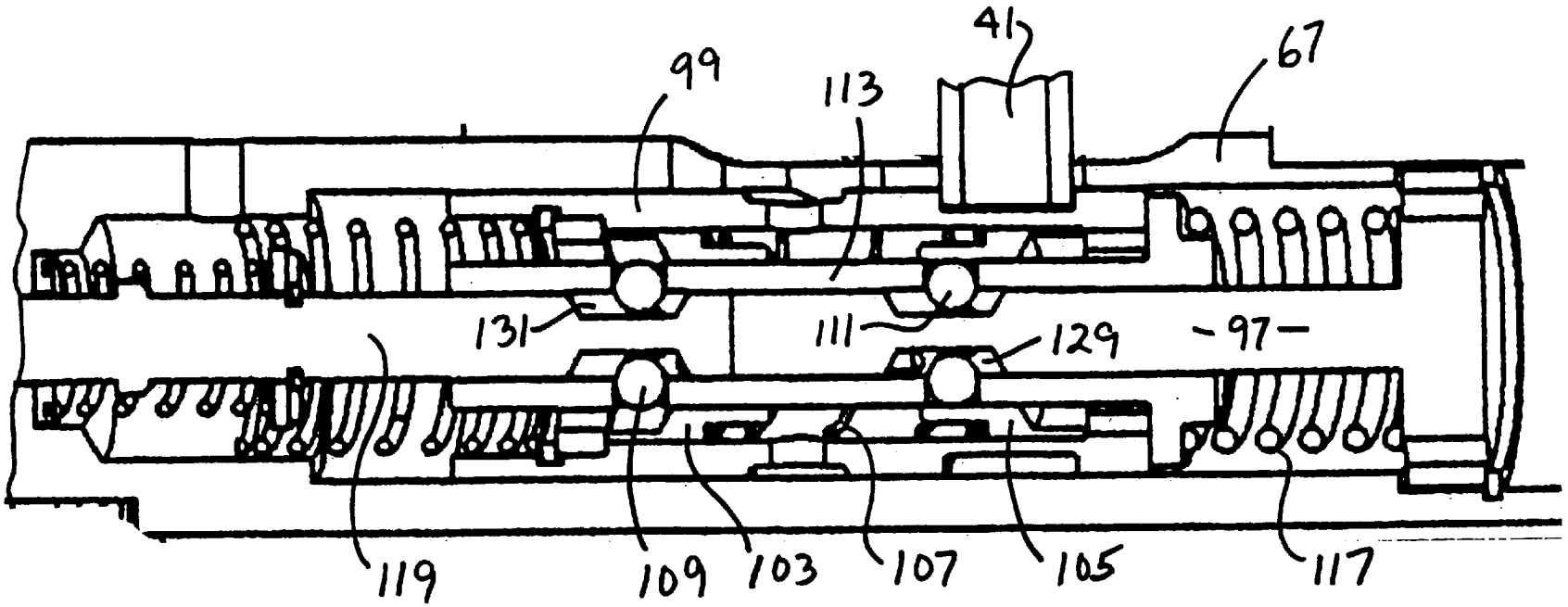
FIG. 10 is a further enlarged, fragmentary, horizontal cross-section of the present invention in a position corresponding to that of FIG. 9.

Referring now primarily to FIGS. 9 and 10, when the cam follower 21 is in engagement with the "peak" of the normal lift portion 17, maximum opening of the exhaust valves 27 and 29 occurs. It should be noted that in FIG. 9, the rocker arm assembly 23 is pivoted counterclockwise to the maximum extent possible, such that the foot member 79 at the lower end of the lash adjustment screw 71 is no longer in engagement with the upper end of the actuator rod 56. As the rocker arm 23 pivots to the position shown in FIG. 9, the result is that the actuator lever 41 moves the outer actuator sleeve 99 as far to the right as possible, relative to the housing 67, thus compressing the energy storage spring 117 to its maximum condition of compression. In the position shown in FIGS. 9 and 10, the compression spring 107 biases primary ball sleeve 103 to the left, and each of the latch balls 109 is moved radially inward through the respective openings 113P in the inner sleeve 113, by the conical surface on the primary ball sleeve 103 (best seen in FIG. 6A), such that the balls 109 are disposed partly within the annular groove 131.

At the same time, in going from the FIG. 8 position to the FIG. 10 position, the compression spring 107 biases the secondary ball sleeve 105 to the right in FIG. 10 to the position shown, thus forcing the secondary latch balls 111 radially inward through the openings 113S in the inner sleeve 113, by the conical surface on the secondary ball sleeve 105 (also best seen in FIG. 6A), such that the balls 111 are disposed partly within the annular groove 129. In the condition represented in FIGS. 9 and 10, the actuator rod 119 is still in abutting relationship to the reaction rod 97, and therefore, the input member 91 remains in the normal, lost-motion condition shown in FIGS. 6 and 8. However, it should be understood that during the normal exhaust valve event which has been described in connection with FIGS. 7–10, instead of the lost motion device 75 being in the meshed, but separated condition shown in FIG. 5, the teeth 87 move down into the spaces between adjacent teeth 85, such that the maximum possible lost motion occurs in the device 75, and the only effective motion transmitted to the exhaust valves 27 and 29 is through the threaded member 33 and the bridge assembly 31, as described previously.

In accordance with an important aspect of the invention, as the rocker arm assembly 23 pivots through the maximum exhaust event position, just described in connection with FIGS. 9 and 10, and the energy storage spring 117 is compressed to its maximum condition of compression, the secondary latch balls 111 lock (or "latch") the inner sleeve 113 relative to the reaction rod 97. Locking the inner sleeve 113 in this manner maintains the energy storage spring 117 in its compressed condition, ready to perform its function, to be described subsequently.

Figure 11:
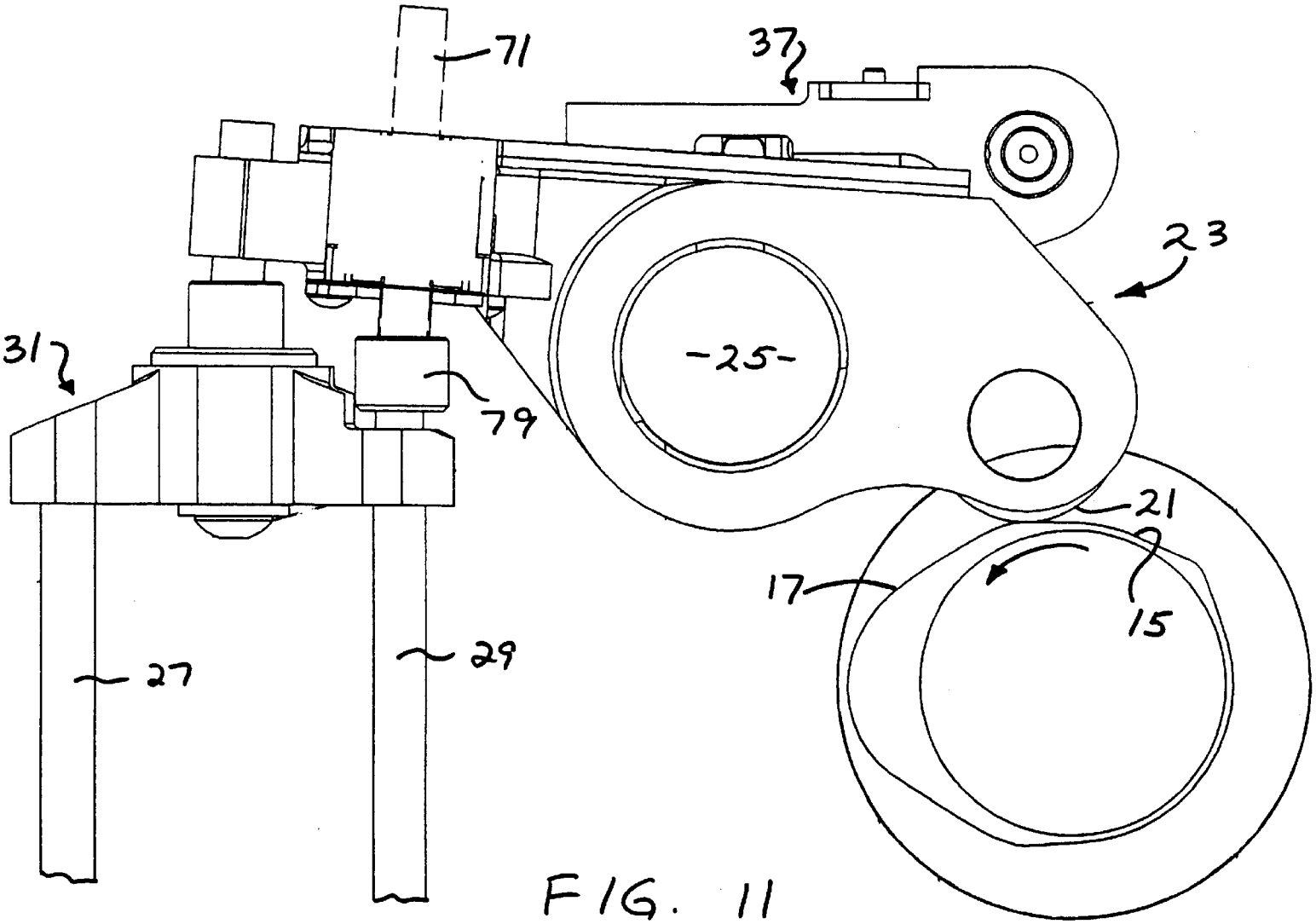
FIG. 11 is a plan view of the valve gear train, just before the exhaust valves close, and with the cam follower about to engage the base circle.
Figure 12:
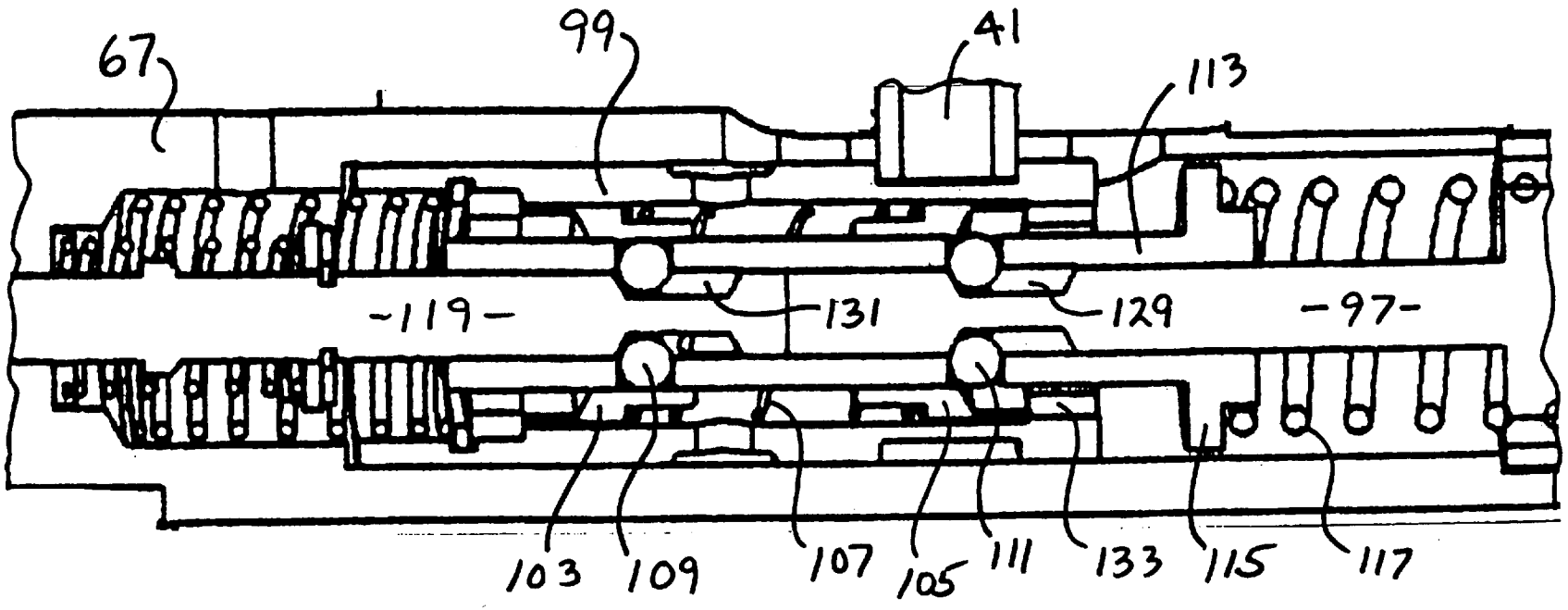
FIG. 12 is an enlarged, fragmentary, horizontal cross-section of the present invention in a position corresponding to that of FIG. 11.

Referring now primarily to FIGS. 11 and 12, the cam follower 21 is at almost the end of the normal lift portion 17 of the cam, and at this point, both of the exhaust valves 27 and 29 would again be closed, or at least nearly closed, as the rocker arm 23 has pivoted in the clockwise direction almost back to its base circle position as shown in FIG. 11. With the rocker arm 23 almost back to its base circle position, the outer actuator sleeve 99 (see FIG. 12) is almost back to its extreme leftward (normal) position, relative to the rocker arm housing 67. As may best be seen by comparing FIG. 12 to FIG. 10, when the outer sleeve 99 returns to its normal leftward position, the spring seat portion 115 of the inner sleeve 113 no longer remains in engagement with the right end of the sleeve 99, as was previously the case. Instead, the inner sleeve 113 moves somewhat to the left from the position shown in FIG. 10 under the influence of the energy storage spring 117, until the secondary latch balls 111 engage the angled surface at the left end of the annular groove 129, thus "latching" the inner sleeve 113 relative to the reaction rod 97, as was mentioned above.

At the same time, the primary latch balls 109 engage an angled surface at the left end of the annular groove 131, thus latching the inner sleeve 113 to the actuator rod 119 also. As this is occurring, the primary ball sleeve 103 passes around the outside of the latch balls 109, under the influence of the compression spring 107, maintaining the balls 109 in the latched position shown in FIG. 12. It should be noted also that, in comparing FIG. 12 to FIG. 10, the movement of the primary and secondary ball sleeves 103 and 105, uncovering the balls 111, and then covering the balls 109, is the result of the leftward movement of the outer sleeve 99, and specifically, of a reduced diameter portion 133 acting against the right end of the secondary ball sleeve 105. When the engine brake assembly reaches the position shown in FIG. 12, the only thing which prevents the release of energy by the energy storage spring 117 is the fact that the secondary ball sleeve 105 is still partly covering the secondary latch balls 111, thus preventing the balls 111 from moving radially outward of the annular groove 129, because the outer sleeve 99 is still not fully back to its normal position.

During the above-described normal exhaust event, the larger diameter portion of the striker has been in engagement with the seat at the upper end of the bore 57, as was described previously. Now, as the cam follower 21 is near the end of the normal lift portion 17, and the exhaust valves 27 and 29 are nearly closed again, the lost motion compression spring 65 begins to return the striker 59 to the position shown in FIG. 3, relative to the bridge member 51, such that there is again a "lost motion" capability available in the bridge assembly 31. This lost motion capability in the bridge assembly 31 will be important during the engine braking portion of the cycle, to be described in connection with FIGS. 15–17.

Figure 13:
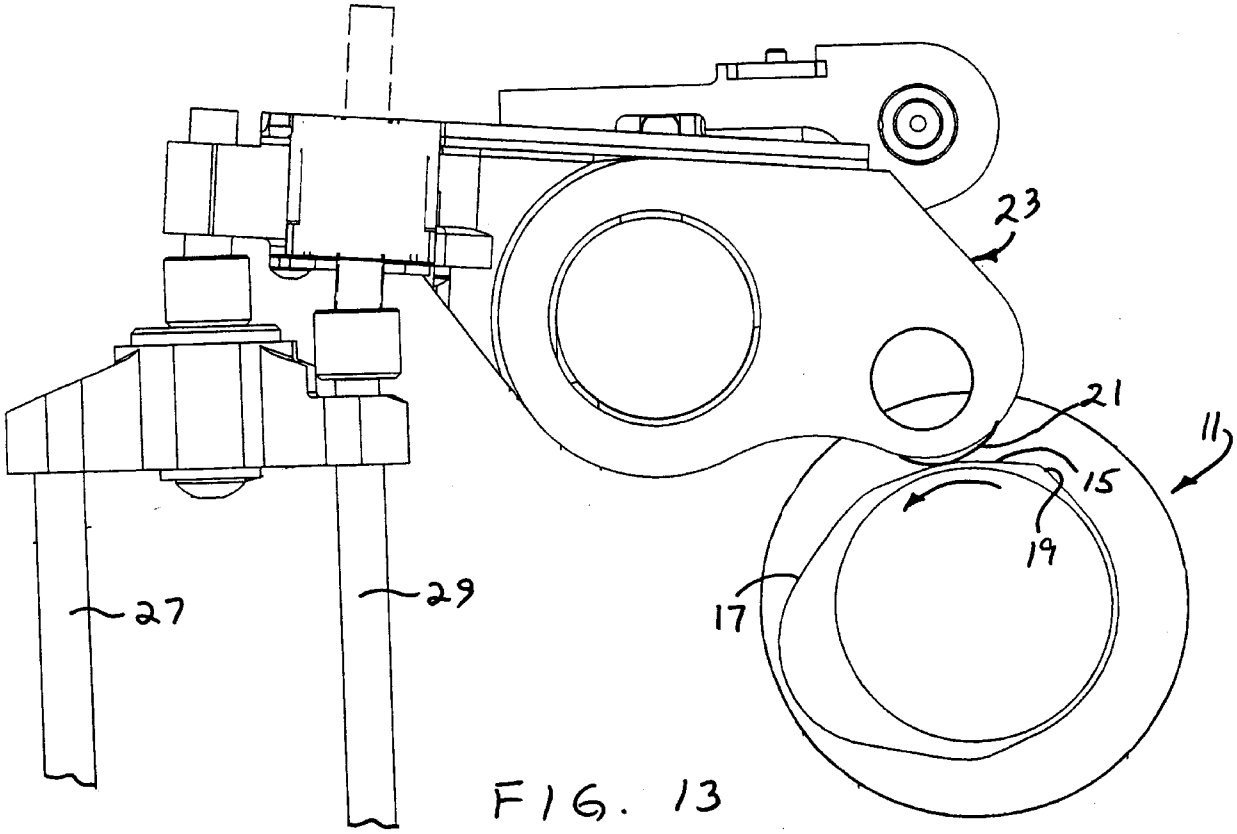
FIG. 13 is a plan view of the valve gear train with the cam follower on the base circle, approaching the brake lift portion of the cam profile.

Referring now primarily to FIGS. 13 and 14, it may be seen that in FIG. 13, the cam follower 21 is again on the base circle portion 15 of the cam (i.e., the part of the base circle portion 15 immediately after the normal lift portion 17), such that the position of the rocker arm 23 and of the exhaust valves 27 and 29 is substantially identical in FIG. 13 to the positions shown in FIG. 1, except for the rotational position of the cam shaft 11. However, in comparing FIG. 14 to FIG. 12, it may be seen that in FIG. 14 (back on base circle), the outer sleeve 99 is again in its fully leftward condition, thus permitting the latch balls 111 to be forced up the angled surface and out of the annular groove 129, to the position shown in FIG. 14. Once the latch balls 111 are out of the annular groove 129, there is nothing to restrain ("latch") the energy storage spring 117, and the spring 117 biases the inner sleeve 113 to the left in FIG. 14. The leftward movement of the inner sleeve 113 is transmitted by the primary latch balls 109 into a leftward movement of the actuator rod 119, compressing the inner compression spring 125, and moving the input member 91 from its normal, lost motion position (shown in FIGS. 2, 6, and 8) to an actuated (non-lost motion) position as shown in FIG. 14.

With the input member 91 moved to the actuated position, the upper castle member 83 is rotated to such a position that the annular arrays of teeth 85 and 87 are now in an "abutting" position (rather than the meshed, lost-motion position), as was described previously. However, because of the compression spring 89 in the lost motion device 75, the teeth 85 and 87 are now only abutting in the sense of being aligned, but they are still held apart axially, and therefore, out of engagement with each other. With the input member 91 in the actuated condition, the return member 121 is also moved to the left in FIG. 14, compressing the return spring 123. It should be noted that when the engine brake assembly reaches the condition shown in FIG. 14, the actuator rod 119 is, for the first time, not in abutting engagement with the reaction rod 97, but instead, there is now a substantial gap between the right end of the actuator rod 119 and the left end of the reaction rod 97.

In accordance with an important aspect of the invention, the movement of the input member 91 from its normal lost motion condition to an actuated condition can occur more rapidly under the influence of the energy storage spring 117 than would be possible with other typical means of actuation, such as hydraulic pressure, or electro-mechanical actuation. Also, the use of the pivotal movement of the rocker arm 23 to compress and then release the energy storage spring 117 insures that the engine braking mechanism is in the desired condition at the appropriate time during the rotation of the camshaft 11.

Referring now primarily to FIGS. 15 and 16, as the cam follower 21 engages the brake lift portion 19 of the cam profile, the rocker arm assembly 23 pivots counterclockwise a small amount from the normal, base circle position (such as FIG. 1), causing the outer actuator sleeve 99 to move somewhat to the right, under the influence of the compression spring 127, to the position shown in FIG. 16. As a result of the rightward movement of the outer sleeve 99, the primary ball sleeve 103 moves to the position shown in FIG. 16, uncovering the primary latch balls 109, and permitting the balls 109 to move radially outward, out of the annular groove 131, to the position shown. It should be understood that the condition shown in FIG. 16 exists for only the briefest time period, because, as soon as the balls 109 move outward to the position shown, there is no longer anything preventing movement to the right of the actuator rod 119, under the biasing force of the spring 125.

When the input member 91 is rotated to the actuated, non-lost-motion position as represented in FIGS. 16 and 17, the teeth 85 and 87 are initially aligned, but out of engagement with each other, as previously described. Then, as the cam follower begins to traverse the brake lift portion 19 of the cam profile 13, the pivotal movement of the rocker arm assembly 23 moves the upper castle member 83 downward, compressing the spring 89, just enough so that the teeth 85 and 87 are now in frictional engagement with each other. This frictional engagement is sufficient to maintain the abutted position of the arrays of teeth 85 and 87, even in the absence of the actuator rod 119 forcing the input member 91 toward the actuated position.

Therefore, almost instantaneously after the primary latch balls 109 move radially outward, the engine brake mechanism moves from the condition shown in FIG. 16 to that shown in FIG. 17, in which the only substantial change is that the actuator rod 119 moves, under the biasing force of the spring 125, out of engagement with the input member 91. The spring 125 biases the actuator rod 119 to the right in FIG. 17, to the position shown, again abutting the reaction rod 97. Thus, the engine brake mechanism, i.e., the mechanism within the rocker arm housing 67, returns to nearly its normal condition, except that the outer sleeve 99 is displaced somewhat to the right of its normal, leftward position, because the cam follower 21 is still in engagement with the brake lift portion 19 of the cam profile.

However, the input member 91 remains in its actuated condition, because of the frictional engagement of the teeth 85 and 87 as described previously. As the cam follower 21 traverses the brake lift portion 19, the rocker arm assembly 23 will pivot counter-clockwise about the support 25. Therefore, the pivotal movement of the rocker arm 23, with the teeth 85 and 87 in abutting engagement will, by means of the mechanism shown in FIG. 4, open the exhaust valve 29. It will be understood by those skilled in the engine art that, during the engine brake event, the exhaust valve 29 doesn't open nearly as much as during the normal exhaust event, the relative amounts of opening of the exhaust valve 29 being represented by the graph of FIG. 18.

After the engine brake mechanism of the invention has operated in the manner described, opening the exhaust valve 29 at about the top of the compression stroke, to release compression, the device will be in the condition shown in FIG. 17. As soon as the cam follower comes down off the brake lift portion 19 of the cam profile, and again engages the base circle portion 15, the spring 89 will bias the castle members 81 and 83 apart enough to "unload" the teeth 85 and 87 so that they are no longer in frictional engagement. When the lost motion device 75 is again in the unloaded condition, the return spring 123 biases the return member 121 to the right in FIG. 17, moving the input member 91 from the actuated condition of FIG. 17 to the normal, lost motion condition of FIG. 2.

It should be understood that, as long as the actuator assembly 37 remains energized, and the actuator lever 41 remains in the annular groove 101, the sequence of steps described above will be repeated during each cycle, i.e., during each rotation of the cam shaft 11. However, when engine braking is not desired by the vehicle operator, the signal 47 to the electromagnetic actuator 45 is discontinued, and the spring 49 biases the lever 41 from the position shown in FIG. 2 in a clockwise direction about the pivot pin 43. With the lever 41 out of the annular groove 101, the entire engine brake mechanism disposed within the housing 67 remains in the position (unactuated, lost-motion) shown in FIG. 2, relative to the housing 67, as the rocker arm assembly 23 undergoes its normal pivotal movement. Thus, the engine brake mechanism of the present invention does not require the expenditure of engine horsepower when it is not operating.

The invention has been described in great detail in the foregoing specification, and it is believed that various alterations and modifications of the invention will become apparent to those skilled in the art from a reading and understanding of the specification. It is intended that all such alterations and modifications are included in the invention; insofar as they come within the scope of the appended claims.

What is claimed is:

1. A compression release engine brake assembly adapted for use with an internal combustion engine of the type including an engine piston reciprocally mounted within a cylinder for cyclical successive compression and expansion strokes, and an exhaust valve operable to open in a normal exhaust lift event and in a brake lift event; said engine including an exhaust valve actuating mechanism for imparting reciprocal movement to said exhaust valve in response to rotation of a cam shaft including a cam profile defining a base circle portion, a normal lift portion and a brake lift portion rotationally displaced from each other on said cam profile; said exhaust valve actuating mechanism including a cam follower adapted for operative engagement with said cam profile and a valve engagement portion adapted for engagement with said exhaust valve; characterized by said exhaust valve actuating mechanism including:

(a) a lost motion device, disposed in series relationship with said exhaust valve and being moveable between a normal lost motion condition and an actuated condition not providing lost motion, in response to movement of an input member between first and second positions, respectively;

(b) a biasing spring normally biasing said input member toward said first position;

(c) an energy storage spring operable, after being compressed to an energy storage condition, to be able to bias said input member toward said second position in opposition to the force of said biasing spring;

(d) a latch mechanism operable to displace said energy storage spring from a non-compressed condition to a compressed condition in response to the movement of said valve actuating mechanism as said cam follower traverses said normal lift portion of said cam profile; and (e) said latch mechanism being operable to release said energy storage spring just before said cam follower traverses said brake lift portion of said cam profile, thereby permitting said energy storage spring to displace from said compressed condition to a relatively non-compressed condition, and thus move said input member to said second position, moving said lost motion device to said actuated condition.

2. A compression release engine brake assembly as claimed in claim 1, characterized by said lost motion device comprising first and second members, including first and second sets of teeth, respectively, said sets of teeth being disposed in face-to-face relationship; said normal, lost motion condition comprising said sets of teeth being in a meshed relationship, and said actuated condition comprising said sets of teeth being in an abutted relationship.

3. A compression release engine brake assembly as claimed in claim 2, characterized by said first and second members of said lost motion device comprising annular members, each disposed to be substantially concentric about a common axis of rotation, said first and second sets of teeth being annular, and said movement between said normal and said actuated conditions comprises rotation of one of said first and second members about said axis of rotation.

4. A compression release engine brake assembly as claimed in claim 1, characterized by said exhaust valve actuating mechanism comprises a rocker arm assembly pivotable about a pivot location in response to successive engagement of said cam follower with said normal lift portion and said brake lift portion of said cam profile.

5. A compression release engine brake assembly as claimed in claim 4, characterized by said movement of said valve actuating mechanism which displaces said energy storage spring from said non-compressed to said compressed condition comprises said pivotable movement of said rocker arm assembly as said cam follower traverses from said base circle portion of said cam profile to said normal lift portion of said cam profile.

6. A compression release engine brake assembly as claimed in claim 5, characterized by said rocker arm assembly defines a linear axis pivotable about said pivot location in the same manner as said rocker arm assembly is pivotable, said input member being linearly moveable, along said linear axis, between said first and second positions, to move said lost motion device between said normal and said actuated conditions.

7. A compression release engine brake assembly as claimed in claim 6, characterized by said lost motion device including an input portion disposed adjacent said linear axis and in operable engagement with said input member, said biasing spring being disposed along said linear axis, said input portion of said lost motion device being disposed axially between said input member and said biasing spring.

8. A compression release engine brake assembly as claimed in claim 6, characterized by said rocker arm assembly defines an elongated bore concentric with said linear axis and including an outer sleeve disposed for reciprocable movement within said bore, said exhaust valve actuating mechanism including an actuator disposed external to said rocker arm assembly, said actuator being disposed to engage said outer sleeve, and cause said reciprocable movement thereof within said bore, in response to said pivotable movement of said rocker arm assembly relative to said actuator.

9. A compression release engine brake assembly as claimed in claim 8, characterized by said energy storage spring being operably associated with said outer sleeve, whereby said reciprocable movement of said outer sleeve, in a first direction away from said lost motion device, results in said energy storage spring being compressed to said energy storage condition.

10. A compression release engine brake assembly as claimed in claim 9, characterized by said latch mechanism including an actuator member disposed within said outer sleeve, and a fixed seat member for said energy storage spring, and being operable, when said energy storage spring is in said energy storage condition, to latch said actuator member in said first position and in a fixed axial relationship relative to said seat member as said outer sleeve engages in said reciprocable movement, in a second direction toward said lost motion device, as said cam follower moves from said normal lift portion of said cam profile to said base circle portion.

11. A compression release engine brake assembly as claimed in claim 10, characterized by said latch mechanism including a moveable seat member for said energy storage spring, disposed axially between said outer sleeve and said energy storage spring, said latch mechanism further including a latch member operable to latch said actuator member relative to said moveable seat member, whereby displacement of said energy storage spring from said compressed condition to said relatively non-compressed condition moves said actuator member from said first position to said second position.

12. A compression release engine brake assembly adapted for use with an internal combustion engine of the type including an engine piston reciprocally mounted within a cylinder for cyclical successive compression and expansion strokes, and a pair of exhaust valves operable to open in a normal exhaust lift event and one of said pair of exhaust valves being operable to open in a brake lift event; said engine including an exhaust valve actuating mechanism for imparting reciprocal movement to said exhaust valves in response to rotation of a cam shaft including a cam profile defining a base circle portion, a normal lift portion and a brake lift portion rotationally displaced from each other on said cam profile; said exhaust valve actuating mechanism including a cam follower adapted for operative engagement with said cam profile and a valve engagement bridge assembly adapted for engagement with said pair of exhaust valves; characterized by:

(a) a lost motion device, disposed in series relationship with said one exhaust valve and being moveable between a normal lost motion condition and an actuated condition not providing lost motion, in response to movement of an input member between first and second positions, respectively;

(b) a biasing spring normally biasing said input member toward said first position;

(c) an energy storage spring operable, after being compressed to an energy storage condition, to be able to bias said input member toward said second position in opposition to the force of said biasing spring;

(d) a latch mechanism operable to displace said energy storage spring from a non-compressed condition to a compressed condition in response to the movement of said valve actuating mechanism as said cam follower traverses said normal lift portion of said cam profile;

(e) said valve engagement bridge assembly including a lost motion spring whereby lost motion occurs between said exhaust valve actuating mechanism and said pair of exhaust valves, through said bridge assembly, during said brake lift event, but said one exhaust valve is actuated only through said lost motion device, during said brake lift event.

* * * * *